United States Patent [19]

Kaneko et al.

[11] Patent Number: 5,010,313

[45] Date of Patent: Apr. 23, 1991

[54] CHIP COIL

[75] Inventors: Toshimi Kaneko; Tetsuya Morinaga; Tetsuo Hatakenaka, all of Nagaokakyo, Japan

[73] Assignee: Murata Manufacturing Co., Ltd., Nagaokakyo, Japan

[21] Appl. No.: 530,402

[22] Filed: May 30, 1990

[30] Foreign Application Priority Data

Jun. 2, 1989 [JP] Japan ..... 1-141896

[51] Int. Cl.[5] ..... H01F 3/00

[52] U.S. Cl. ..... 335/296; 335/297; 336/83

[58] Field of Search ..... 335/296, 297; 336/83, 336/196

[56] References Cited

U.S. PATENT DOCUMENTS 4,926,151 5/1990 Morinaga ..... 335/296

*Primary Examiner*—George Harris

*Attorney, Agent, or Firm*—Burns, Doane, Swecker & Mathis

[57] ABSTRACT

A chip coil wherein the coil wound around the core is enclosed with a sleeve core. The upper surfaces of the core and the sleeve core are ground so as to adjust the inductance of the chip coil.

3 Claims, 2 Drawing Sheets

CHIP COIL

BACKGROUND OF THE INVENTION

1. Field of the Invention

The present invention relates to a chip coil, and more specifically to an improved chip coil so as to prevent electromagnetic interference from scattering.

2. Description of Related Art

With regard to a chip coil for an oscillation circuit of an oscillator, it is a well-known way of preventing electromagnetic interference from scattering to enclose the coil with a sleeve core made of a magnetic material. In this case, the inductance (L) becomes 3.5 to 4 times, that is, more than 0.5 $\mu H/mm^3T$, and the quality factor (Q) becomes more than 100.

However, such chip coils varies in inductance (L) to about 30% depending on the accuracy on the sizes of the parts and the errors in putting the parts together, and consequently it is necessary to provide a variable type of condenser for an oscillation circuit in parallel to such a chip coil. Hence, here comes a problem that the costs of parts and adjustments increase.

SUMMARY OF THE INVENTION

It is therefore an object of the present invention to provide chip coils with a sleeve core, which do not vary so much in inductance.

In order to attain the object above, in a chip coil according to the present invention, the upper surface of the core wounded with a coil and the upper surface of the sleeve core are ground so as to adjust the inductance. The grinding, for example, is to be performed to make the upper surfaces of the core and the sleeve core lateral and even. The upper surfaces of the core and the sleeve core may also be cut diagonally at the ends and ground.

When the upper surfaces of the core and the sleeve core are ground evenly, the inductance decreases as the amount of the grinding increases as indicated by the graph in FIG. 3. Hence, if the inductances of newly produced chip coils are measured respectively, and the upper surfaces of the core and the sleeve core of each chip coil are ground referring to a prepared special graph, it will be possible to make the variation in inductance among the chip coils within 2% to 5%.

According to the present invention, the inductance of a chip coil can be decreased arbitrarily. Thereby, obtained by the present invention are chip coils whose quality factors and inductances are both high, and the variation in inductance is extremely small. Since the variation in inductance among the chip coils is very small, it is possible to use fixed type of condensers as the resonance condensers, thereby cutting the costs of parts and adjustments.

BRIEF DESCRIPTION OF THE DRAWINGS

This and other objects and features of the present invention will become apparent from the following description taken in conjunction with the preferred embodiments thereof with reference to the accompanying drawings, in which.

DESCRIPTION OF THE PREFERRED EMBODIMENTS

Preferred embodiments of the present invention will be described below with reference to the accompanying drawings.

Figure 1:
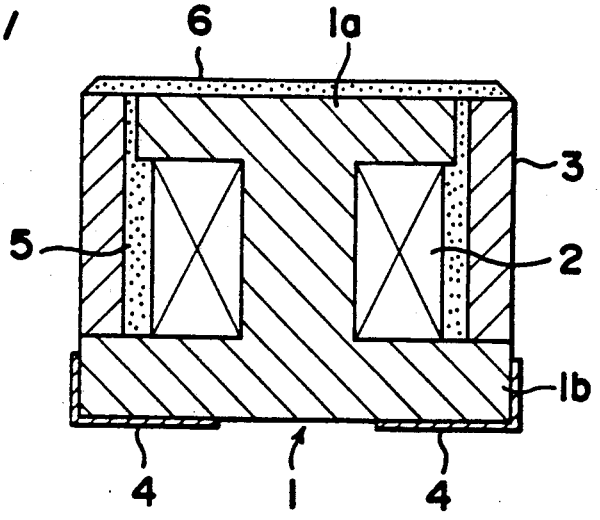
FIG. 1 is a vertical sectional view of a first examplary chip coil embodying the principles of the present invention.

In reference to FIG. 1, the chip coil comprises a square pole shaped core 1 made of a magnetic material, a coil 2 wound around the core 1 and a square sleeve core 3 made of a magnetic material. The core 1 has an upper flange 1*a* and a lower flange 1*b*. The coil 2 is wound around the core 1 between the flanges 1*a* and 1*b*, and the end of the coil 2 is connected to two electrodes 4 disposed at the lower flange 1*b*. The sleeve core 3 is so mounted on the lower flange 1*b* that the sleeve core 3 encloses the coil 2, and the sleeve core 3 extends its top to the same height as the upper flange 1*a*.The cores 1 and 3 are fixed temporarily by filling adhesive 5 between the sleeve core 3 and the coil 2, and thereafter fixed permanently by spreading adhesive 6 on the upper surfaces.

Figure 2:
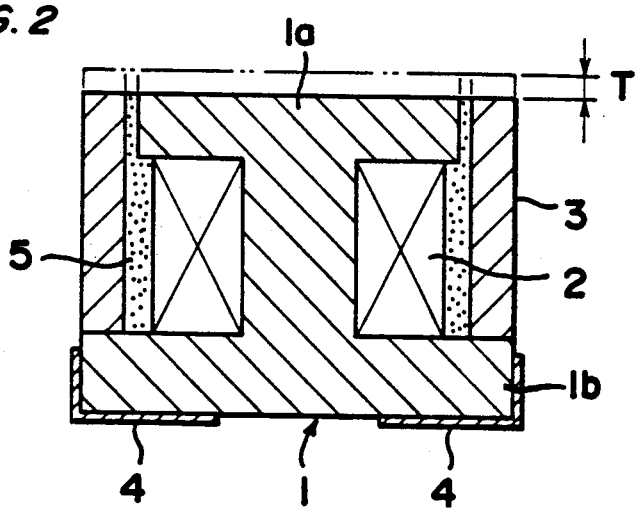
FIG. 2 is a vertical sectional view of the chip coil shown in FIG. 1 showing the grinding of the core and the sleeve core.
Figure 3:
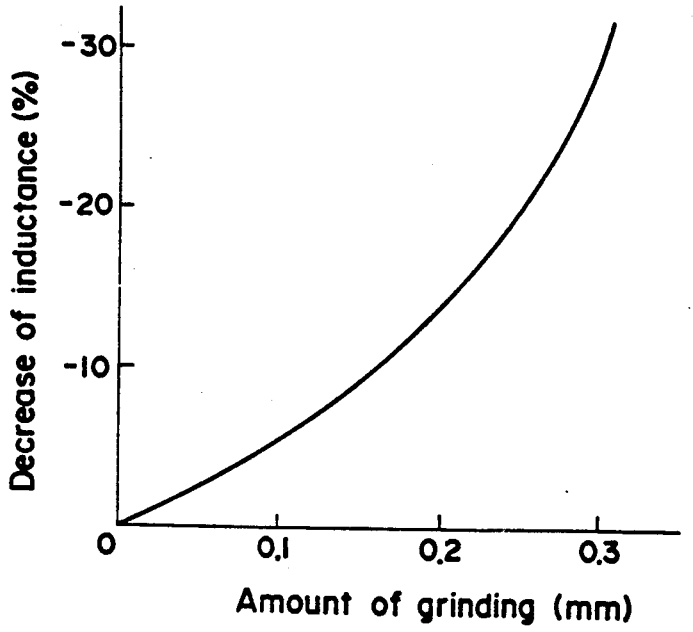
FIG. 3 is a graph plotting the amount of the grinding versus the decrease of the inductance (L)

It is an essential aspect of the present invention that the upper surfaces of the upper flange 1*a* and the sleeve core 3 are cut and ground as a whole by the thickness (T) as shown in FIG. 2 before the cores 1 and 3 are fixed permanently with the adhesive 6. This grinding is performed to adjust the inductance of the chip coil to a predetermined value. The relation between the amount (mm) of the grinding and the decrease (%) of the inductance, which was figured out by the inventors through experiments, is shown in FIG. 3. The inductance (L) of newly produced chip coils are measured respectively, and each of them is submitted to the grinding of the upper surface in accordance with the measured inductance (L) referring to the graph in FIG. 3 so that the chip coils have a desired inductance. Every of these chip coils has a high quality factor, more than 100, and a high inductance, more than 0.5 $\mu H/mm^3T$ because of the sleeve core 3. Also, the variation in inductance (L) among the chip coils is 2% to 5% because of the grinding of the upper surfaces of the cores 1 and 3, and further more accurate grinding of the upper surfaces will reduce the variation in inductance (L) more. Hence, the chip coils have an excellent characteristic for oscillation circuits, and fixed type of condensers are able to be applied to the chip coils as resonance condensers.

Figure 4:
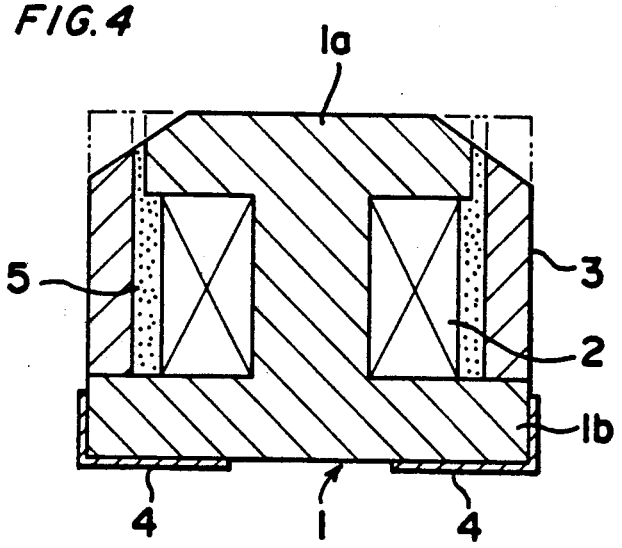
FIG. 4 is a vertical sectional view of a second examplary chip coil embodying the principles of the present invention.

FIG. 4 shows a second examplary chip coil, and the upper surface of the sleeve core 3 and the upper flange 1*a* of the core 1 are cut diagonally and ground.

Figure 5:
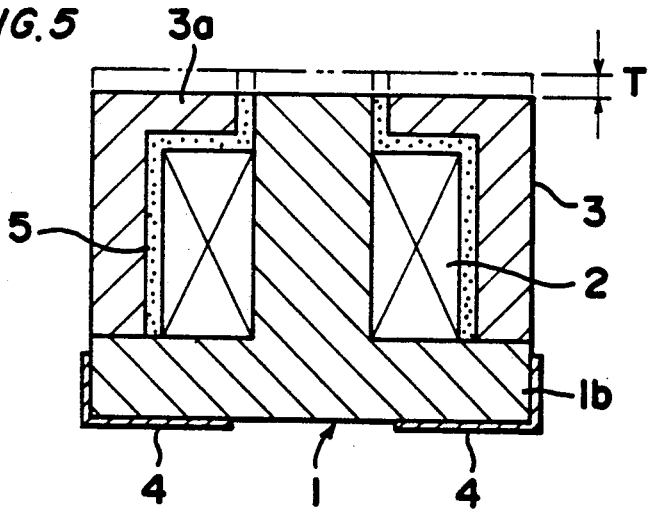
FIG. 5 is a vertical sectional view of a third examplary chip coil embodying the principles of the present invention.

FIG. 5 shows a third examplary chip coil. The core 1 is shaped like a square pole with only a lower flange 1*b*, and the sleeve core 3 has a ceiling 3*a* in contact with the upper tip of the core 1. The inductance is able to be adjusted by grinding the upper surfaces of the cores 1 and 3 evenly by a certain thickness T, likewise.

Further, the parts and the sections shown in FIGS. 4 and 5 which were already introduced in FIG. 1 are numbered the same as in FIG. 1. The decrease of the inductance (L) in accordance with the grinding of the upper surface has the same tendency as indicated by the graph in FIG. 3.

Figure 6:
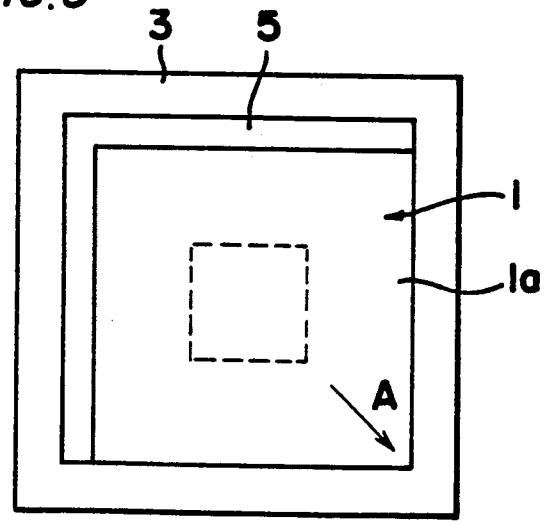
FIG. 6 is a plan view of a modified chip coil of the first examplary chip coil.

FIG. 6 shows a modified chip coil of the chip coil shown in FIG. 1. In fixing the cores 1 and 3, the core 3 is deviated in the direction of arrow A so that the variation in inductance (L) can be reduced from 30% to less than 20%. Thereby, when the grinding of the upper surfaces of the cores 1 and 3 is applied to the modified chip coil shown in FIG. 6, it is possible to reduce the variation in inductance (L) more.

Although the present invention has been described in connection with the preferred embodiments thereof, it is to be noted that various changes and modifications are apparent to those who are skilled in the art. Such changes and modifications are to be understood as included within the scope of the present invention as defined by the appended claims. For example, the cores 1 and 3 need not be square poles and may be cylindrical.

What is claimed is:

1. A chip coil comprising:

a core made of a magnetic material;

a coil wound around the core;

a sleeve core enclosing the coil, the sleeve core made of a magnetic material, wherein the upper surface of the core and the upper surface of the sleeve core are ground so as to adjust the inductance of the chip coil.

2. A chip coil as claimed in claim 1, wherein the upper surfaces of the core and the sleeve core are ground laterally and evenly.

3. A chip coil as claimed in claim 1, wherein the upper surfaces of the core and the sleeve core are cut diagonally at the ends and ground.

* * * * *